US005208985A

United States Patent [19]

Carter

[11] Patent Number: 5,208,985

[45] Date of Patent: May 11, 1993

[54] CUE TIP CONDITIONING DEVICE AND METHOD

[75] Inventor: Robert H. Carter, Hartwell, Ga.

[73] Assignee: Glen L. Sadler, Jr., Toney, Ala.

[21] Appl. No.: 244,286

[22] Filed: Sep. 15, 1988

[51] Int. Cl.[5] ..... B27L 9/00

[52] U.S. Cl. ..... 30/494; 30/358; 30/360

[58] Field of Search ..... 30/494, 358, 360, 381, 30/366, 367

[56] References Cited

U.S. PATENT DOCUMENTS 1,517,931 12/1924 Wible ..... 30/358

3,411,555 11/1968 Herpich ..... 81/121.1

FOREIGN PATENT DOCUMENTS 23534 11/1921 France ..... 30/494

*Primary Examiner*—M. Rachuba

*Attorney, Agent, or Firm*—Phillips & Beumer

[57] ABSTRACT

A cue tip conditioning device and method is disclosed which includes a circular array of pins surrounded by a casing which may be manually held to tap the sharpened ends of the needles against the surface of a cue tip. A beveled surface allows the rounded side circumference of the cue tip to be tapped and perforated without contacting and damaging the cue stick.

27 Claims, 2 Drawing Sheets

CUE TIP CONDITIONING DEVICE AND METHOD

Background of the Invention

The invention relates to a device for conditioning a tip of a cue stick in preparation for receiving chalk. More particularly, the invention relates to a device for perforating the cue tip of a cue stick that is hardened and glazed over with chalk so that the cue stick will accept chalk.

Cue sticks used in pool, billiards, and snooker have a cue tip which is typically constructed from a leather material on which chalk is placed. The chalk serves as an adhesive so that the cue stick will strike the ball without miscuing. During the game, chalk is regularly applied to the cue tip as needed to prevent miscuing. However, the problem occurs that the chalk becomes hardened and glazed over the end of the cue tip after substantial use. The chalk no longer is retained on the tip or serves as an adhesive. The hardened and glazed over chalk surface on the cue tip will not accept the chalk and causes miscuing.

Numerous devices have been proposed for scuffing or otherwise roughening the cue tip so that it will accept chalk. For example, a device commonly called a "Brad" scuffer has been used which includes a metal curved disc having metallic flakes coated on the concave surface of the disc. The roughened concave surface is rubbed over the tip to scuff the tip and break up the hardened, glazed surface. However, after a period of time of use, the scuffer can change the diameter and/or the shape of the tip effecting shots. Another device used is commonly referred to as a "tip tapper". This device includes a small metal plate with metal square projections extending out of the plate. The metal projections are tapped against the end of the cue stick in order to break up the hardened, glazed surface so the tip will accept chalk. However, this operation is not highly effective for conditioning the tip to accept chalk. Another device commonly referred to as a "cue tip shaper" includes a short tube with a concave bottom surface on which metallic flakes have been deposited. The end of the cue tip is placed in the tube and the tip rotated to scuff up the tip and shape the tip. While this does maintain the shape of the cue tip it wears the tip down over a relatively short period of time. Other devices have also been proposed for breaking up the hardened, glazed over chalk surfaces, such as blades.

The conventional cue tip holds only enough chalk for one reliable shot, and normally the cue tip is chalked before each shot. If the player forgets to chalk, the shot will more than likely be miscued.

Accordingly, an object of the invention is to provide a cue tip conditioning device which will break up the hardened, glazed over chalk surface caused by long use of chalk so that the cue tip will accept chalk.

Another object of the invention is to provide a device for conditioning the cue tip of a cue stick to accept chalk without wearing down the cue tip.

Another object of the invention is to provide a device and method for conditioning the tip of a cue stick to accept chalk and to store chalk so that, in the event that the player forgets to chalk the cue stick, some additional chalk is present.

Another object of the invention is to provide a method for conditioning a cue tip of a cue stick to break up the hardened, glazed over surface by perforating the tip with small holes which not only break up the surface but accept additional chalk for storage which may be applied to the cue stick in the event the player forgets to chalk the cue tip.

SUMMARY OF THE INVENTION

The above objectives are accomplished according to the present invention by providing a holder casing having a cylindrical bore in which a circular array of sharpened needles is arranged. By manually grasping the holder casing, the sharpened ends of the needles may be tapped against the cue tip surface to make minute perforations in the end of the cue tip which breaks up the hardened, glazed over chalk surface and conditions the tip surface to once again accept chalk. In addition, chalk is stored in a multitude of well dispersed minute bore perforations over the tip surface which may be later deposited on the cue tip surface. By providing a beveled surface at the opened end of the cylindrical bore and recessing the needle points below the bevel, the entire circumference of the cue tip may be tapped and perforated without damaging the casing of the cue stick.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
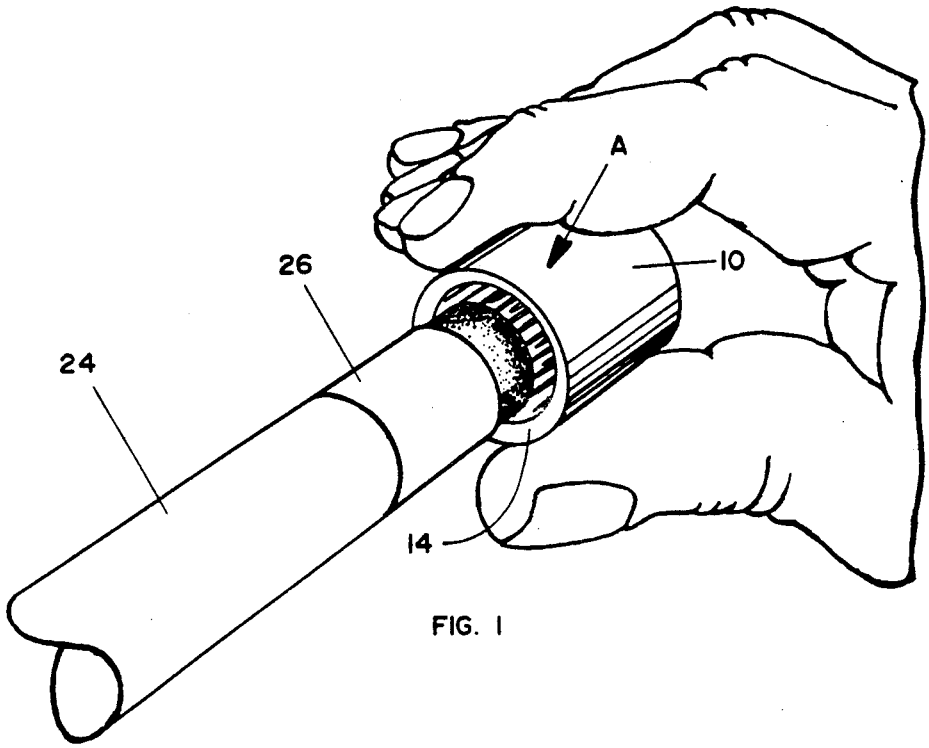
FIG. 1 is a perspective view of a cue tip conditioning device and method according to the invention in an operative position.
Figure 2:
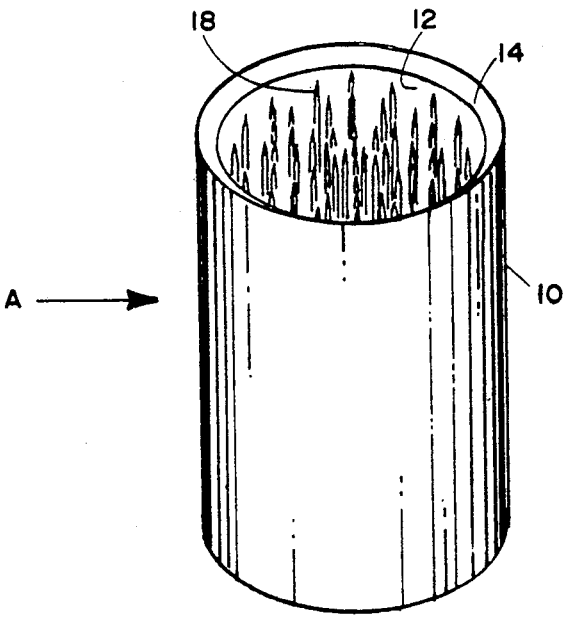
FIG. 2 is a perspective view of a cue tip conditioning device according to the invention.
Figure 3:
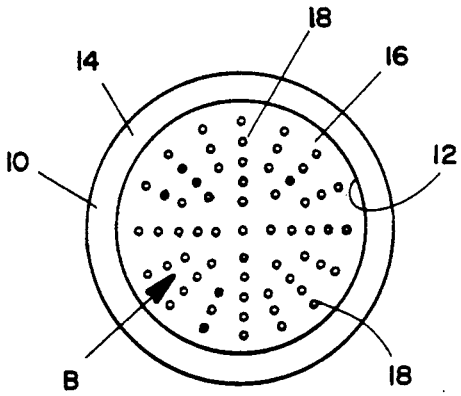
FIG. 3 is a top plan view of a cue tip conditioning device according to the invention.

Referring now in more detail to the drawings, a device, designated generally at A, is illustrated for conditioning a cue tip to accept chalk. Device A includes a stainless holder casing sleeve 10 having a cylindrical bore 12 with an outer beveled annular surface 14. At the bottom of casing 10 is an adhesive layer 16 forms a base for casing 10 in which a plurality of needles 18 are embedded. The ends 20 of the needles are sharpened to perforate a cue tip 22 of a cue stick 24. The pins are arranged in a circular array B as can best be seen in FIG. 3.

Figure 5:
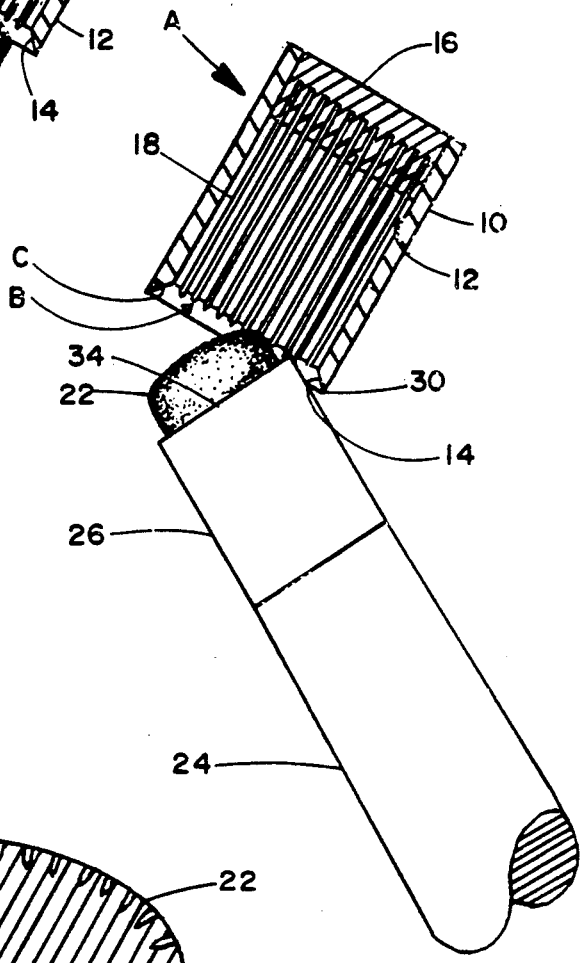
FIG. 5 is an elevation with the cue tip device in section turned for tapping a rounded side of the cue tip.
Figure 6:
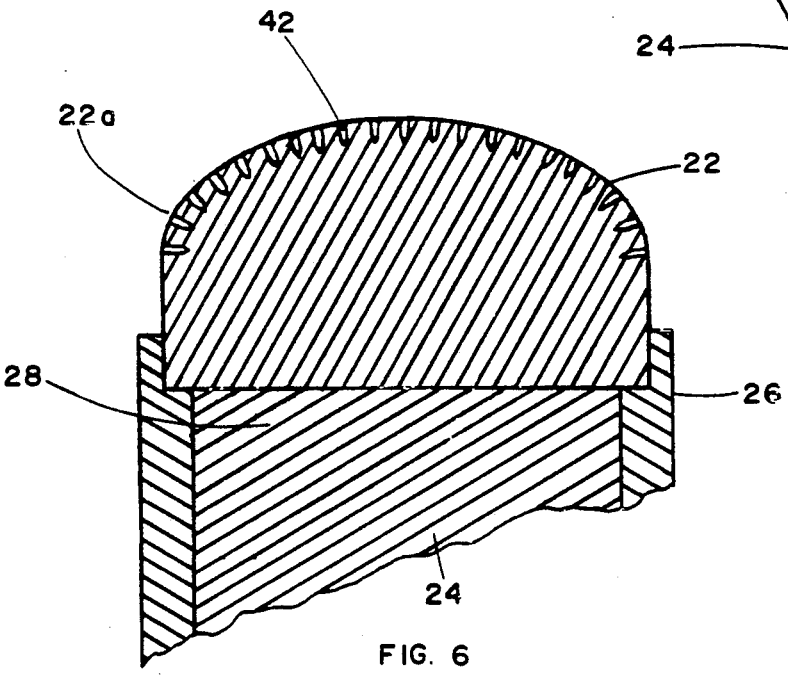
FIG. 6 is a enlarged sectional view of a cue tip which has been conditioned for accepting chalk according to the invention.

In a preferred embodiment, sharpened ends 20 of needles 18 terminate in a parallel plane which is below a plane passing through the lower annular edge of beveled surface 14. This is for several reasons. First, it enables the device to be carried in a pants o other pocket without a cap so that the needles do not engage the fabric of the pocket. Secondly, it enables the rounded side circumference 22*a* of the cue tip to be perforated without damaging the ferrule 26 or wood body 28 of cue stick 24. As can best be seen in FIG. 5, casing 10 may be angularly disposed to cue tip 22 so that the rounded sides of the cue tip are perforated without an outer edge 30 of casing 10 engaging the plastic ferrule or wood stick. In use, the needles may be tapped against the cue tip with a good deal of force to perforate the tip without cracking or chipping of the ferrule. In this manner, by providing the beveled edge, all of the pins can be used to perforate the cue tip around the entire circumference of the cue tip.

Figure 4:
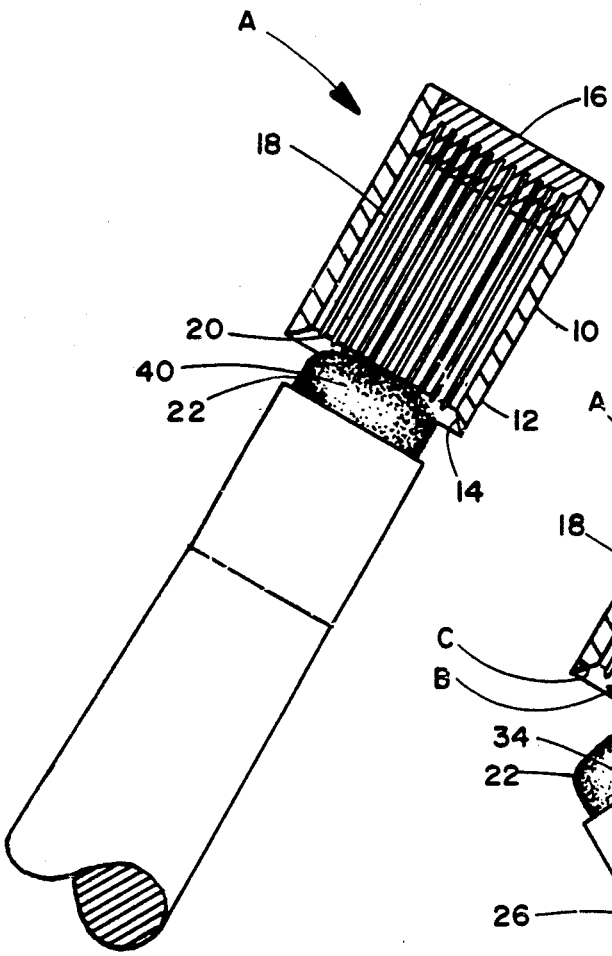
FIG. 4 is an elevation illustrating a cue tip conditioning device in section.

As can best be seen in FIG. 4, casing 10 has central bore 12 which is formed in the casing extending from base 16 to an open top 32. Array B of needles 18 is carried by base 16 within central bore 12 terminating free sharpened ends 20 which perforate cue tip 22 to break up a hardened, glazed over chalk surface and condition the cue tip for accepting chalk.

Contoured means C is formed around open top 32 of central bore 12 for protecting a ferrule 34 of cue stick 24 from engagement with a casing and possible damage. As can best be seen in FIGS. 4 and 5, contoured means C includes annular beveled surface 14 formed continuously around open top 32 of central bore 12. Sharpened free ends 20 of needles 18 terminate generally short of annular beveled surface 12, and annular beveled surface 12 tapers inwardly toward the sharpened needles to generally guide cue tip 22 into pin array B. Circular pin array B has a cross sectional diameter generally equal to that of the cue tip. Beveled surface 14 tapering from an outer free edge 36 of casing 10 toward sharpened ends 20 of needles 18 facilitates tapping of the sharpened ends against cue tip 22 around generally the entire circumference 40 of cue tip 22 without contacting said cue stick or cue stick ferrule.

In a method for conditioning a surface of a cue stick to accept chalk according to the invention, holder casing 10 is provided for holding an array of pins and the pins are tapped against the cue tip to perforate the surface of the cue tip and break up a hardened glazed over surface of chalk on the cue tip. Next, the method contemplates applying chalk to the perforated end of the cue tip.

The method contemplates forming perforations in the surface of the cue tip in such a manner that chalk applied to said surface is stored in minute perforation bores 42. In the event the player forgets to chalk their stick, chalk from the store will prevent miscuing.

While a preferred embodiment of the invention has been described using specific terms, such description is for illustrative purposes only, and it is to be understood that changes and variations may be made without departing from the spirit or scope of the following claims.

What is claimed is:

1. A device for conditioning a cue tip of a cue stick to accept chalk comprising:

a base;

an array of needles carried by said base terminating in free sharpened ends;

a holder carried with said base for manually tapping said needles against said cue tip to break up a hardened glazed over chalk surface on said cue tip and form minute perforations in said cue tip so that said cue tip accepts chalk; and said holder including a protective casing carried by said base surrounding said array of needles for protecting objects from coming into contact accidentally with the sharpened ends of said needles.

2. The device of claim 1 wherein said casing terminates in a free end which extends past the sharpened ends of said needles.

3. For use with a cue stick having a cue tip secured by a ferrule spaced apart from the outer end of said tip, a conditioning tool for breaking up a hardened glazed over chalk surface on said cue stick so that said cue tip accepts chalk comprising:

a casing having a base and an open top;

a central bore formed in said casing extending generally from said base to said open top;

an array of needles carried by said base within said central bore terminating in free sharpened ends for perforating said cue tip to break up said hardened glazed over chalk surface and conditioning said cue tip for accepting chalk; and said casing adjacent to its open top surrounding said array of needles for protecting objects from coming into contact accidentally with the sharpened ends of said needles.

4. The device of claim 3 including contour means formed around said open top of said central bore for protecting said ferrule of said cue stick from engagement with said casing.

5. The device of claim 4 wherein said contour means includes:

an annular beveled surface formed continuously around said open top of said central bore; and said annular beveled surface tapering inwardly toward said sharpened needles.

6. The device of claim 3 wherein said central bore has a circular cross section and said needles are arranged in a circular array.

7. The device of claim 6 wherein said circular needle array has a diameter generally equal to a diameter of said cue tip.

8. The device of claim 3 including:

a beveled surface formed around said open top of said central bore;

said sharpened ends of said needles terminating generally at or below said beveled surface; and said beveled surface tapering from an outer free edge of said casing toward said sharpened ends of said needles to facilitate tapping of said sharpened ends of said needles against said cue tip around generally the entire circumference of said cue tip without contacting said cue stick or cue stick ferrule.

9. In a method for conditioning a surface of a cue stick to accept chalk, the combination comprising the steps of:

providing a holder for holding an array of pins having sharpened ends; and tapping said cue tip with said pins to perforate said surfaces of said cue tip and break up a hardened glazed over surface of chalk on said cue tip.

10. The method of claim 9 including applying chalk to said perforated end of said cue tip.

11. The method of claim 9 including forming said perforations in said surface of said cue tip in such a manner that said chalk applied to said surface is stored in minute perforations for application to said cue tip surface.

12. The conditioning tool of claim 3 wherein said open top of said casing defines a plane parallel to said base.

13. The conditioning tool of claim 12 wherein said sharpened ends are disposed in a plane parallel to and spaced apart inwardly from the plane of said open top.

14. A device for penetrating a cup tip comprising:

a housing with a top surface having a cavity formed in said top surface defining a cue tip opening; and multiple upright pin members secured within said cavity, with each member having a pointed end portion directed outwardly from said cavity and a terminus proximate said cue tip opening.

15. The device of claim 14 wherein said cue tip opening defines a top plane wherein said terminus does not extend past said plane.

16. The device of claim 14 wherein each pin member comprises an elongated shaft arranged lengthwise in said cavity.

17. The device of claim 16 wherein each pin member has about the same length.

18. The device of claim 16 wherein each pin member includes a base portion and said cavity includes a bottom wall that supports each base portion.

19. The device of claim wherein said cavity has an upper region and a lower region, said terminus being located in a point plane within said upper region below said top plane.

20. The device of claim 19 wherein said point plane and said top plane are parallel.

21. The device of claim 14 wherein each of said upright members has a substantially similar shape and is positioned in a side-by-side relationship within said cavity.

22. An implement for puncturing a cue tip to form chalk openings comprising:

a receptacle with a plurality of pin members arranged lengthwise in said receptacle, said pin members having a base portion secured to said receptacle and a pointed free end portion directed outwardly from said receptacle, said receptacle having a cue tip opening defining a top plane with said free end portion terminating proximate said top plane.

23. The implement of claim 22 wherein said pin members comprise elongated shafts arranged parallel to each other in said receptacle.

24. The implement of claim 23 wherein said receptacle includes a bottom wall which is parallel to said top plane with side walls extending about perpendicularly from said bottom wall, said shafts extending about parallel with said side walls.

25. The implement of claim 24 wherein said shafts have about equal length, and said base portions are supported by said bottom wall.

26. The implement of claim 24 wherein said shafts have a substantially similar shape.

27. A method for retaining chalk on the surface of a cue top comprising:

providing an implement containing a plurality of pin members having exposed pointed ends;

moving said implement adjacent to said cue tip, with said pointed ends in contact with a predetermined portion of said cue tip;

forcing said pointed ends straight through said surface;

withdrawing said pointed ends straight outwardly from said surface; and rubbing chalk over said surface.

* * * * *